US006299290B1

(12) United States Patent
Silverbrook

(10) Patent No.: US 6,299,290 B1
(45) Date of Patent: Oct. 9, 2001

(54) FLUID FLOW RESTRICTION IN AN INKJET PRINTHEAD

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/425,417

(22) Filed: Oct. 19, 1999

(51) Int. Cl.[7] ..... B41J 2/04; B41J 2/015; B41J 2/135

(52) U.S. Cl. ..... 347/54; 347/20; 347/44

(58) Field of Search ..... 347/54, 20, 44, 347/29, 90

(56) References Cited

U.S. PATENT DOCUMENTS 6,027,205 * 2/2000 Herbert ..... 347/54
6,239,821 * 5/2001 Silverbrook ..... 347/54

* cited by examiner

*Primary Examiner*—Thinh Nguyen

(57) ABSTRACT

An inkjet printhead, typically constructed by a MEMS process, includes a large number of nozzle chambers with ink ejection nozzle apertures and a paddle moveable in each chamber by an actuator to deliver ink through the nozzle. Each actuator extends through an aperture in a side wall of the nozzle chamber and is provided with a shield to inhibit leaking or wicking of ink from the chamber.

5 Claims, 5 Drawing Sheets

FLUID FLOW RESTRICTION IN AN INKJET PRINTHEAD

FIELD OF THE INVENTION

The present invention relates to the field of fluid ejection devices such as inkjet printers and, in particular, discloses the utilization of an actuator aperture protection shield.

BACKGROUND OF THE INVENTION

Many different types of printing have been invented, a large number of which are presently in use. The known forms of printers have a variety of methods for marking the print media with a relevant marking media. Commonly used forms of printing include offset printing, laser printing and copying devices, dot matrix type impact printers, thermal paper printers, film recorders, thermal wax printers, dye sublimation printers and inkjet printers both of the drop on demand and continuous flow type. Each type of printer has its own advantages and problems when considering cost, speed, quality, reliability, simplicity of construction and operation etc.

In recent years, the field of inkjet printing, wherein each individual pixel of ink is derived from one or more ink nozzles has become increasingly popular primarily due to its inexpensive and versatile nature.

Many different techniques on inkjet printing have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Inkjet printers themselves come in many different types. The utilisation of a continuous stream ink in inkjet printing appears to date back to at least 1929 wherein U.S. Pat. No. 1,941,001 by Hansell discloses a simple form of continuous stream electro-static inkjet printing.

U.S. Pat. No. 3,596,275 by Sweet also discloses a process of a continuous inkjet printing including the step wherein the inkjet stream is modulated by a high frequency electro-static field so as to cause drop separation. This technique is still utilized by several manufacturers including Elmjet and Scitex (see also U.S. Pat. No. 3,373,437 by Sweet et al).

Piezo-electric inkjet printers are also one form of commonly utilized inkjet printing device. Piezo-electric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezo electric crystal, Stemme in U.S. Pat. No. 3,747,120 (1972) discloses a bend mode of piezo-electric operation, Howkins in U.S. Pat. No. 4,459,601 discloses a Piezo electric push mode actuation of the inkjet stream and Fischbeck in U.S. Pat. No. 4,584,590 which discloses a sheer mode type of piezo-electric transducer element.

Recently, thermal inkjet printing has become an extremely popular form of inkjet printing. The inkjet printing techniques include those disclosed by Endo et al in GB 2007162 (1979) and Vaught et al in U.S. Pat. No. 4,490,728. Both the aforementioned references disclosed inkjet printing techniques rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

Recently, the present applicant has disclosed for example, an Australian Provisional Patent No. PP6534 entitled "Micromechanical Device and Method (IJ46a)", filed Oct. 16, 1998 a new form of inkjet printer containing an ink ejection mechanism that includes a thermal bend actuator actuated in an external ambient environment which is interconnected with a paddle mechanism utilised for the ejection of ink.

Unfortunately, in the aforementioned inkjet printing arrangement as in most inkjet printing arrangements, there is a tendency of the ink ejection nozzles to dry out over time which can result in the build up of crustaceans etc. Further, there is also the propensity of such devices to become clogged by other means such as foreign bodies in the ink or paper fibers, material etc. around the ink ejection nozzle.

Further, in the aforementioned arrangement, there is a significant gap left in one wall of the ink ejection chamber, the gap being required and utilized by the movement of the thermal actuator up and down during an ejection cycle. Unfortunately, the provision of the slot may cause ink flow to wick out of the nozzle chamber and along the thermal actuator which can cause problems with ink loss due to wicking. Such ink loss is generally undesirable.

SUMMARY OF THE INVENTION

In accordance with a first aspect of the present invention, there is provided an inkjet printhead apparatus comprising:

- a plurality of nozzle chambers each having a nozzle aperture defined in one wall thereof for the ejection of ink out of said chamber and a second aperture for the insertion of an actuator mechanism;
- an ink supply channel interconnected with said nozzle chamber;
- a paddle moveable by an actuator operable to eject ink from said nozzle chamber, said actuator including:
- a first portion located externally of said nozzle chamber and
- a second portion located internally of said nozzle chamber, supporting said paddle;
- an interconnecting portion interconnecting said first portion and said second portion through said second aperture, said interconnecting portion further including a protruding shield formed adjacent said second aperture and positioned so as to restrict the flow of fluid through said second aperture.

The shield can comprise a hydrophobic surface. The interconnecting portion typically moves in an upwardly defined direction towards the liquid ejection aperture, and the shield can be formed on a top surface of the portion. The actuator preferably can include a thermal expansion actuator located in the first portion.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED EMBODIMENTS

In the preferred embodiment, a paddle is formed with a "poker" device attached in a central portion thereof such that, during movement of the paddle, the poker device pokes any unwanted foreign body or material which should congregate around the nozzle, out of the nozzle. The poker can be formed during fabrication of the ink ejection nozzle arrangement by means of a chemical mechanical planarization step with, preferably, the formation being a byproduct of the normal formation steps for forming the ink ejection nozzle on arrangement on a semi-conductor wafer utilizing standard MEMS processing techniques.

Additionally, in order to restrict the amount of wicking and the opportunities for wicking, an actuator slot guard is provided, formed on the bend actuator itself, closely adjacent to the actuator slot so as to restrict the opportunities for flow of fluid out of the nozzle chamber due to surface tension effects.

Figure 1:
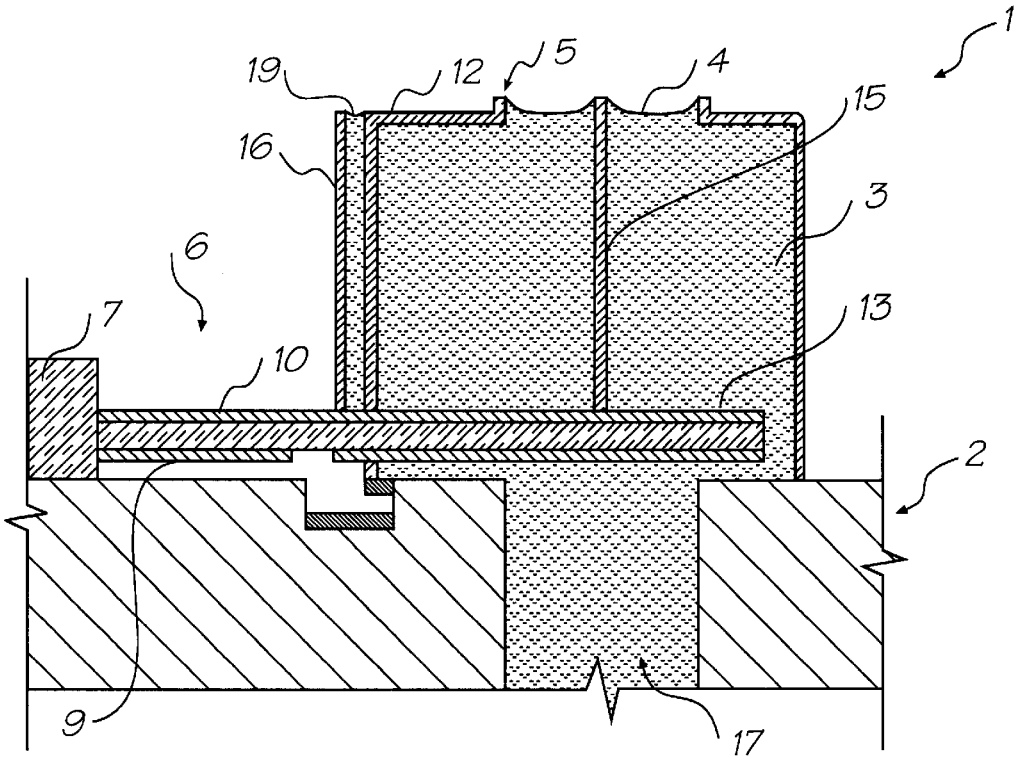
FIGS. 1 to 3 illustrates schematically the operational principles of the preferred embodiments.
Figure 2:
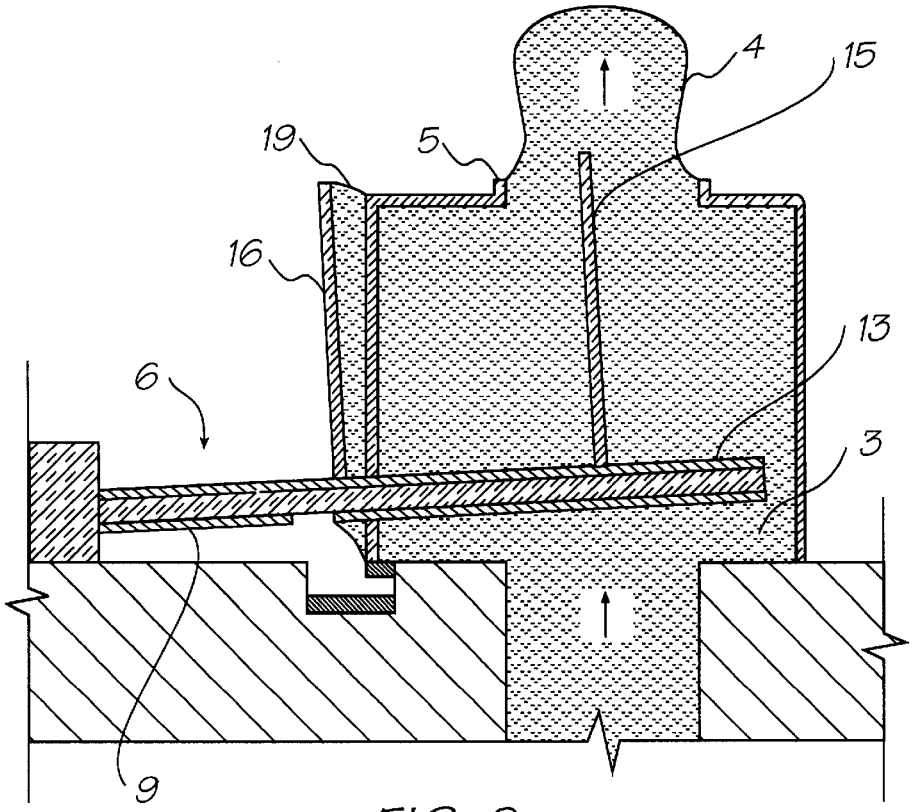
Figure 3:
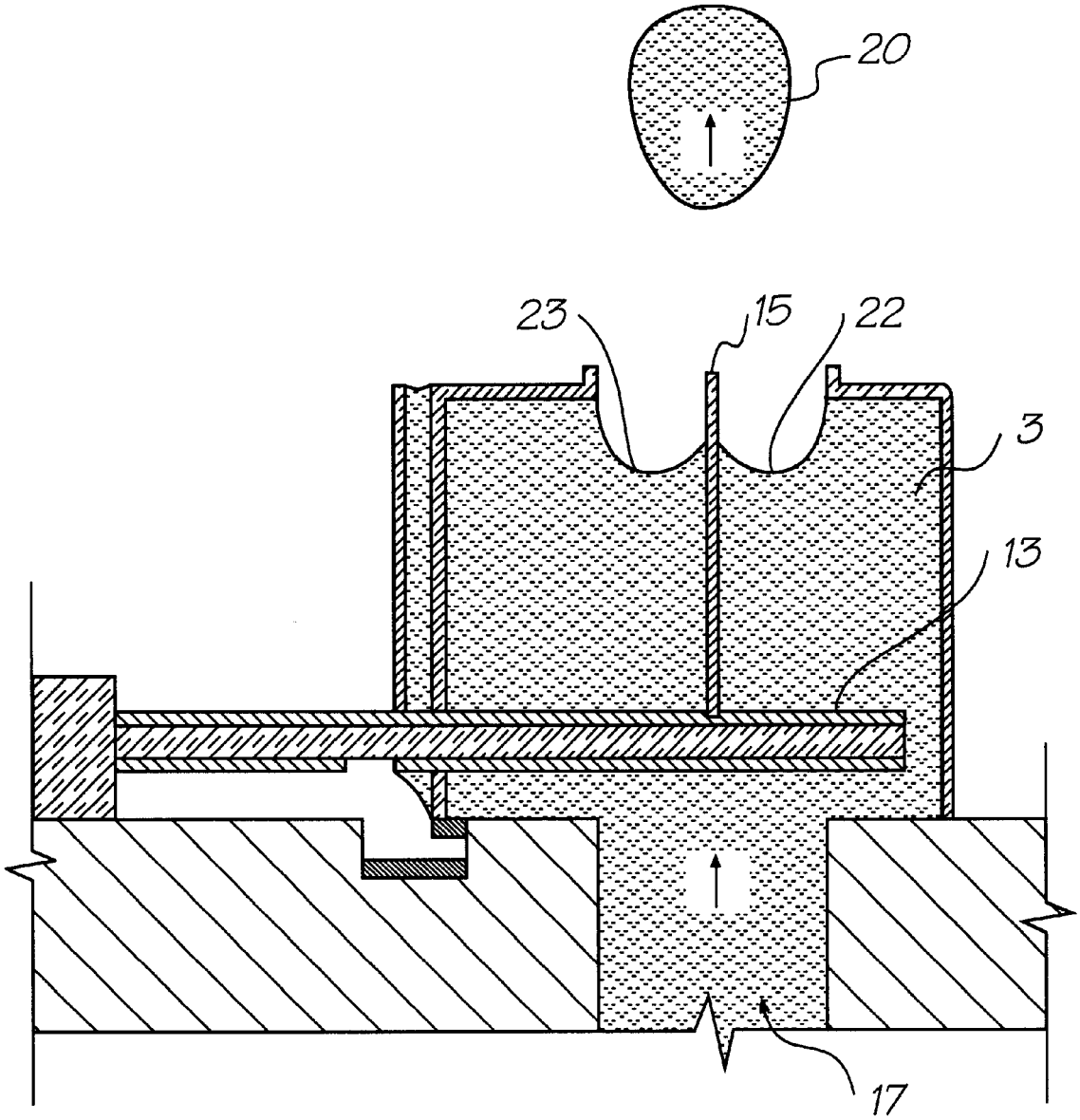

Turning now to FIG. 1 to FIG. 3 there will now be explained the operational principles of the preferred embodiment. In FIG. 1, there is illustrated a nozzle arrangement 1 which is formed on the substrate 2 which can comprise a semi-conductor substrate or the like. The arrangement 1 includes a nozzle chamber 3 which is normally filled with ink so as to form a meniscus 4 which surrounds a nozzle rim 5. A thermal bend actuator device 6 is attached to post 7 and includes a conductive heater portion 9 which is normally balanced with a corresponding layer 10 in thermal equilibrium. The actuator 6 passes through a slot in the wall 12 of the nozzle chamber and inside forms a nozzle ejection paddle 13. On the paddle 13 is formed a "poker" 15 which is formed when forming the walls of the nozzle chamber 3. Also formed on the actuator 6 is a actuator slot protection shield 16. An ink supply channel 17 is also formed through the surface of the substrate 2 utilizing highly anisotropic etching of the substrate 2. During operation, ink flows out of the nozzle chamber 3 so as to form a layer 19 between the slot in the wall 12 and the actuator slot protection barrier 16. The protection shield is profiled to substantially mate with the slot but to be slightly spaced apart therefrom so that any meniscus eg. 19 is of small dimensions.

Next, as illustrated in FIG. 2, when it is desired to eject a drop from the nozzle chamber 3, the bottom conductive thermal actuator 9 is heated electrically so as to undergo a rapid expansion which in turn results in the rapid upward movement of the paddle 13. The rapid upward movement of the paddle 13 results in ink flow out of the nozzle so as to form bulging ink meniscus 4. Importantly, the movement of the actuator 6 results in the poker 15 moving up through the plane of the nozzle rim so as to assist in the ejection of any debris which may be in the vicinity of the nozzle rim 5.

Further, the movement of the actuator 6 results in a slight movement of the actuator slot protection barrier 16 which maintains substantially the small dimensioned meniscus 19 thereby reducing the opportunity for ink wicking along surfaces. Subsequently, the conductive heater 9 is turned off and the actuator 6 begins to rapidly return to its original position. The forward momentum of the ink around meniscus 4 in addition to the backflow due to return movement of the actuator 6 results in a general necking and breaking of the meniscus 4 so as to form a drop.

The situation a short time later is as illustrated in FIG. 3 where a drop 20 proceeds to the print media and the meniscus collapses around poker 15 so as to form menisci 22, 23. The formation of the menisci 22, 23 result in a high surface tension pressure being exerted in the nozzle chamber 3 which results in ink being drawn into the nozzle chamber 3 via ink supply channel 17 so as to rapidly refill the nozzle chamber 3. The utilization of the poker 15 increases the speed of refill in addition to ensuring that no air bubble forms within the nozzle chamber 3 by means of the meniscus attaching to the surface of the nozzle paddle 13 and remaining there. The poker 15 ensures that the meniscus eg. 22, 23 will run along the poker 15 so as to refill in the nozzle chamber. Additionally, the area around the actuator slot barrier 16 remains substantially stable minimizing the opportunities for wicking therefrom.

Figure 4:
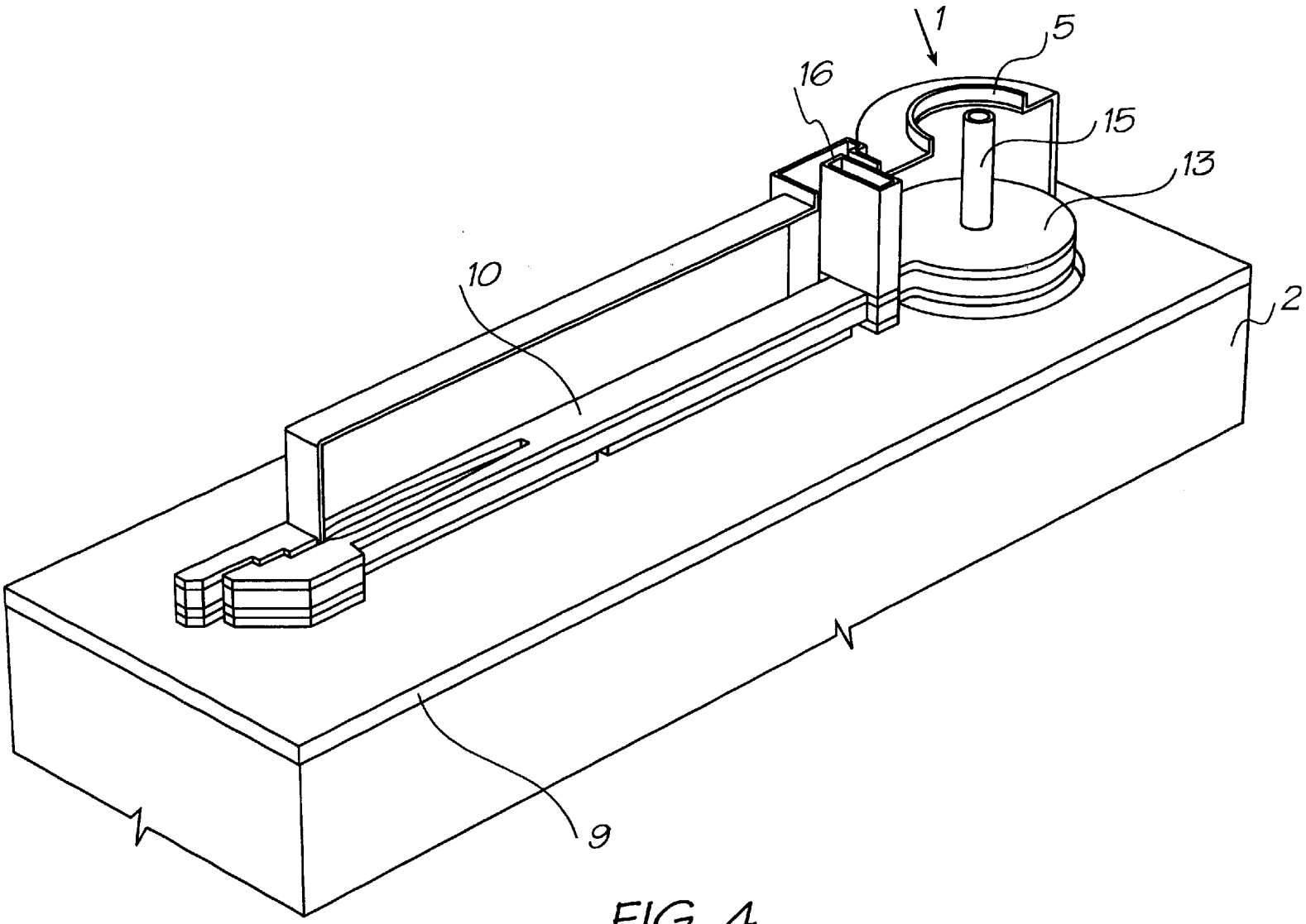
FIG. 4 is a side perspective view, partly in section, of a single nozzle arrangement of the preferred embodiment.
Figure 5:
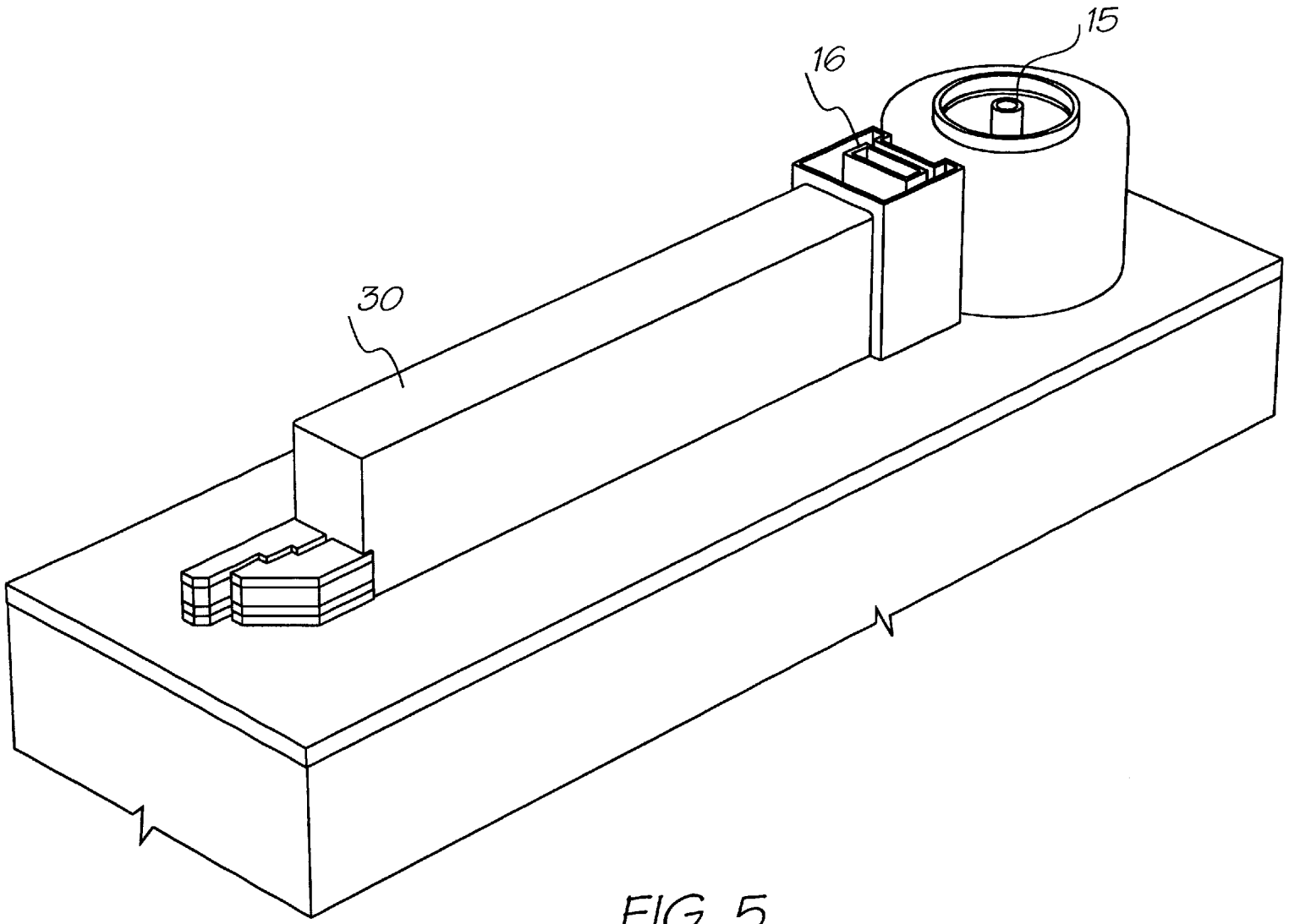
FIG. 5 illustrates a side perspective of a single nozzle including the shroud arrangement.
Figure 6:
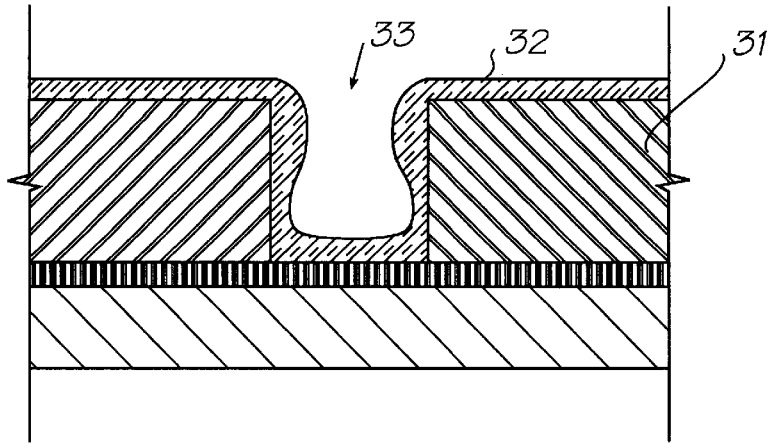
FIGS. 6 to 8 illustrates the principles of chemical, mechanical planarization utilized in the formation of the preferred embodiment.
Figure 7:
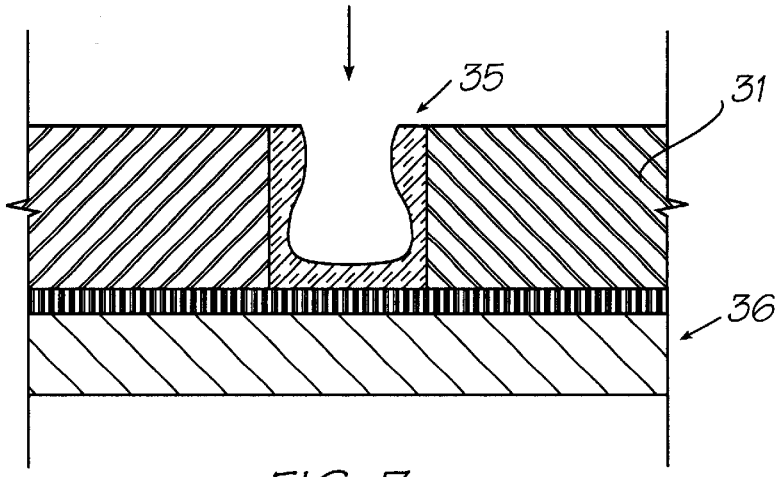
Figure 8:
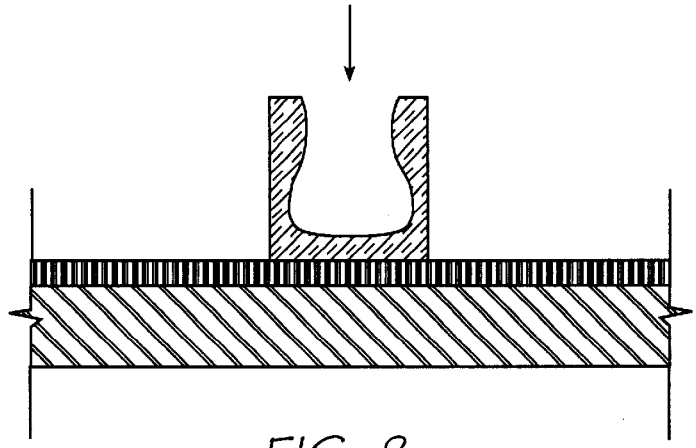

Turning now to FIG. 4 there is illustrated a side perspective view of a single nozzle arrangement 1 shown in sections. FIG. 5 illustrates a side perspective view of a single nozzle including a protective shroud 30. The central poker 15 and protection shield 16 are as previously discussed. The construction of the arrangement of FIGS. 4 and 5 can be as a result of the simple modification of deep mask steps utilized in the construction of the nozzle arrangement in Australian Provisional Patent Application PP6534 (the contents of which are specifically incorporated by cross-reference) so as to include the poker 15 and shield 16. The poker and guard are constructed primarily by means of a chemical mechanical planarization step which is illustrated schematically in FIG. 6 to FIG. 8. The poker 15 and shield 16 are constructed by depositing a surface layer 32 on a sacrificial layer 31 which includes a series of etched vias eg. 33. Subsequently, as illustrated in FIG. 7, the top layer is chemically and mechanically planarized off so as to leave the underlying structure 35 which is attached to lower structural layers 36. Subsequently, as illustrated in FIG. 8, the sacrificial layer 31 is etched away leaving the resulting structure as required.

It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

What is claimed is:

1. An inkjet printhead apparatus comprising:

a plurality of nozzle chambers each having a nozzle aperture defined in one wall thereof for the ejection of ink out of said chamber and a second aperture for the insertion of an actuator mechanism;

an ink supply channel interconnected with said nozzle chamber;

a paddle moveable by an actuator operable to eject ink from said nozzle chamber, said actuator including:

a first portion located externally of said nozzle chamber and a second portion located internally of said nozzle chamber, supporting said paddle;

an interconnecting portion interconnecting said first portion and said second portion through said second aperture, said interconnecting portion further including a protruding shield formed adjacent said second aperture and positioned so as to restrict the flow of fluid through said second aperture.

2. An apparatus as claimed in claim 1 wherein said shield comprises a hydrophobic surface.

3. An apparatus as claimed in claim 1 wherein, in use, said interconnecting portion moves in an upwardly defined direction towards said liquid ejection aperture, and said shield is formed on an upper surface of said interconnecting portion.

4. An apparatus as claimed in claim 1 wherein said actuator includes a thermal expansion actuator.

5. An apparatus as claimed in claim 4 wherein said thermal expansion actuator is located in said first portion of said actuator.

* * * * *

UNITED STATES PATENT AND TRADEMARK OFFICE

CERTIFICATE OF CORRECTION

PATENT NO. : 6,299,290 B1
APPLICATION NO. : 09/425417
DATED : October 9, 2001
INVENTOR(S) : Kia Silverbrook It is certified that error appears in the above-identified patent and that said Letters Patent is hereby corrected as shown below:

On the title page, add item:

--(30) Foreign Application Priority Data

Nov. 9, 1998 (AU) .....PP7023--

Signed and Sealed this

Eighth Day of May, 2007

JON W. DUDAS
*Director of the United States Patent and Trademark Office*